US007866300B2

(12) United States Patent
Kammerstetter et al.

(10) Patent No.: US 7,866,300 B2
(45) Date of Patent: Jan. 11, 2011

(54) DEVICE FOR INJECTING FUEL INTO THE COMBUSTION CHAMBER OF AN INTERNAL COMBUSTION ENGINE

(75) Inventors: Heribert Kammerstetter, Oberalm (AT); Jaroslav Hlousek, Golling (AT); Christian Graspeuntner, Hallein (AT); Markus Kathan, Salzburg (AT); Christian Meisl, St. Jakob (AT)

(73) Assignees: Robert Bosch GmbH, Stuttgart-Feuerbach (DE); AVL List GmbH, Graz (AT)

( * ) Notice: Subject to any disclaimer, the term of this patent is extended or adjusted under 35 U.S.C. 154(b) by 213 days.

(21) Appl. No.: 12/308,403

(22) PCT Filed: Jun. 13, 2007

(86) PCT No.: PCT/AT2007/000286

§ 371 (c)(1),
(2), (4) Date: Dec. 15, 2008

(87) PCT Pub. No.: WO2007/143768

PCT Pub. Date: Dec. 21, 2007

(65) Prior Publication Data

US 2010/0263626 A1 Oct. 21, 2010

(30) Foreign Application Priority Data

Jun. 13, 2006 (AT) ..... A 1008/2006
Jan. 12, 2007 (AT) ..... A 65/2007

(51) Int. Cl.
*F02M 55/02* (2006.01)

(52) U.S. Cl. ..... 123/468; 123/456; 123/447

(58) Field of Classification Search ..... 123/447, 123/456, 468

See application file for complete search history.

(56) References Cited

U.S. PATENT DOCUMENTS

| | | | | |
|---|---|---|---|---|
| 5,896,843 | A * | 4/1999 | Lorraine | 123/467 |
| 6,601,564 | B2 * | 8/2003 | Davey | 123/456 |
| 6,761,150 | B2 * | 7/2004 | Zdroik | 123/456 |
| 7,497,202 | B2 * | 3/2009 | Cvengros et al. | 123/456 |
| 7,681,553 | B2 * | 3/2010 | Cora et al. | 123/456 |
| 2002/0043249 | A1 * | 4/2002 | Lee et al. | 123/456 |
| 2004/0200457 | A1 | 10/2004 | Gottemoller et al. | |
| 2005/0263198 | A1 * | 12/2005 | Kamada et al. | 138/30 |
| 2009/0050111 | A1 * | 2/2009 | Cora et al. | 123/456 |

* cited by examiner

*Primary Examiner*—Erick Solis
(74) *Attorney, Agent, or Firm*—Fitch, Even, Tabin & Flannery

(57) ABSTRACT

In a device for the injection of fuel into the combustion chamber of an internal combustion engine, including at least one high-pressure accumulator (1), an injector (4), at least one high-pressure line (7) connecting the high-pressure accumulator (1) with the injector (4), and a resonator line (16) arranged in parallel with the high-pressure line (7) between the injector (4) and the high-pressure accumulator (1) and including a resonator throttle (17) on the side of the high-pressure accumulator, the resonator line (16) is formed by an insert piece (18) pressed into the bore of the high-pressure line and is, in particular, formed within the same.

13 Claims, 3 Drawing Sheets

DEVICE FOR INJECTING FUEL INTO THE COMBUSTION CHAMBER OF AN INTERNAL COMBUSTION ENGINE

CROSS-REFERENCE TO RELATED APPLICATIONS

This is a U.S. National Phase of International Application PCT/AT2007/000286, filed Jun. 13, 2007 and claims the benefit of foreign priority under 35 U.S.C. §119 from Austrian Patent Applications A 1997/2006, filed Jun. 13, 2006, and A 65/2007, filed Jan. 12, 2007, the entire disclosures of which are hereby incorporated by reference herein.

BACKGROUND OF THE INVENTION

The invention relates to a device for the injection of fuel into the combustion chamber of an internal combustion engine, including at least one high-pressure accumulator, an injector, at least one high-pressure line connecting the high-pressure accumulator with the injector, and a resonator line arranged in parallel with the high-pressure line between the injector and the high-pressure accumulator and including a resonator throttle on the side of the high-pressure accumulator.

In a common rail system, electronically controlled injectors are used for the injection of fuel into the combustion chamber of an engine. The servo valves employed in such injectors cause the injection nozzle to close very rapidly such that strong pressure pulsations will be created on the nozzle seat due to the inertia of the fuel in the consecutive high-pressure bores, which will result in intense wear. The pressure peaks occurring there in the most unfavourable cases will be up to 500 bar higher than the rail pressure.

With rapidly following injection procedures, such pressure vibrations will, moreover, lead to strong deviations of the injection rates. If, for instance, a pressure vibration is induced on the nozzle seat by a preinjection, the injected amount for the second, subsequent injection, at a constant opening time of the nozzle needle, will depend on whether said second injection has been effected at a maximum or at a minimum of said pressure vibration. As low a pressure vibration as possible is therefore desirable at the injector in any operating state of the hydraulic system.

In the patent literature, numerous measures have been described to avoid pressure vibrations in hydraulic systems. In most cases, these comprise attenuation volumes, throttle assemblies, valve assemblies or combinations of such measures. Most frequently employed are throttle assemblies, which ought to contribute to the dissipation of the flow energy into static pressure energy.

Thus, it is, for instance, known from EP 1 217 202 A1 to arrange in parallel, in a high-pressure bore departing from a high-pressure line (common rail) and leading to an injector, a non-return valve as well as a dissipation element so as to enable a more rapid attenuation of pressure vibrations.

In order to minimize pressure pulsations in a fuel injection line that is feed from a high-pressure line, a throttle reducing the cross section of the injection line is provided at the connection site to the high-pressure line according to DE 160 785 A1.

Furthermore, it is also known to use the pressure vibrations occurring in an injection system for the pressure-modulated formation of the injection course. In this context, it is known from DE 102 09 527 A1 to connect the pressure volumes of a first and a second valve via a pressure line. The first and second valves are connected in series, the first valve controlling the pressure supply to the pressure volume of the second valve and the injection pressure level being controlled by the second valve during the injection phases.

DE 102 47 775 A1 addresses a problem which will occur at several injection pulses per cycle, if the time intervals of the former are only a few microseconds. Due to the pressure drop occurring at every injection, the forming pressure waves will not be sufficiently attenuated and, hence, cause uncontrollable irregularities in subsequent injections. The problem is solved by the aid of attenuation means comprised of a porous material, for instance a sintered metal insert, on which the pressure waves are attenuated by multiple reflections and absorptions. The pressure losses occurring thereby are disadvantageous.

The drawbacks of the prior in the following approaches to solve this problem essentially are:

Throttled Flow:

If a throttle for attenuating pressure vibrations is provided between the high-pressure accumulator and the injector, said throttle will, as a side effect, also cause throttling of the main flow. The system pressure prevailing in the rail can thus no longer be utilized to its full extent for an injection. The more effectively the throttle is able to attenuate pressure vibrations, the larger the pressure loss also during injection.

Specific Valve Assemblies:

Valves constitute vibrating systems by themselves and, thus, exhibit pronounced time behaviours which, being additional sources of interference, are undesirable in injection systems. As mechanically moved elements, valves are afflicted with tolerances and suffer from high wear phenomena on account of high actuation frequencies.

Attenuation Volumes:

The common rail as such already provides the largest attenuation volume available in the system. It is true that a substantial reduction of the pressure vibrations could be achieved by an increase in the rail volume. Yet, this would involve the disadvantage of the system becoming very sluggish and no longer readily allowing rapid pressure changes.

A system improved over that prior art is known from DE 103 07 871 A1. In that system, a resonator line comprising a resonator throttle on the side of the high-pressure accumulator is arranged in parallel with the high-pressure line, between the injector and the high-pressure accumulator.

Departing from such a configuration, the present invention aims to improve a device for injecting fuel into the combustion chamber of an internal combustion engine by constructive means as simple as possible, while enabling the avoidance, or as rapid a reduction as possible, of the pressure vibrations harmful to the individual components.

In accordance with the invention, this object is achieved in that the resonator line is comprised of an insert piece pressed into the bore of the high-pressure line and is, in particular, formed within the same. In this case, no separate bore is required for the resonator line such that manufacturing expenses will be considerably reduced. Moreover, such a construction ensures that the respective sections of the high-pressure line and the resonator line are equally long so that, after a reflection of the pressure waves, the extinction of the waves will be caused in the point of juncture.

In a preferred manner, the resonator line is formed as a central bore within the insert piece. The cross sections of the insert piece and the bore of the high-pressure line may have mutually differing contours such that flow cross-sections of the high-pressure line are formed between the insert piece and the wall of the bore of the high-pressure line. In this respect, at least two, in a particularly preferred manner three, circular-segment-shaped flow cross-sections are provided. The flow cross-section of the high-pressure line, in a preferred manner, is to substantially correspond with the flow cross-section of the resonator line.

The invention, therefore, contemplates that the high-pressure line, by the pressing-in of an insert piece, is divided into two independent sections, one of which is equipped with a throttle such that the pressure vibrations created on the nozzle seat will be differently reflected in the two sections, and the reflected vibrations will almost become extinguished because of their phase shift. In doing so, the function of the hydraulic system is reproduced in exactly the same manner as without any throttle, since only the line vibrations are extinguished. The essential advantages of such a configuration are:

- no moved parts
- no elevated pressure drop between the pressure accumulator and the injector due to additional throttle sites
- true extinction of pressure vibrations (no attenuation)
- extinction is fully effective already after the first exciting half-wave
- the extinction mechanism is symmetrical with the formation mechanism such that any external influences such as temperature, pressure etc. will be compensated for.

According to a preferred further development, a particularly effective extinction will be achieved if the length of the resonator line is tuned to the length of the high-pressure line in such a manner as to cause the mutual attenuation or extinction of the pressure vibrations induced by the injector. The length of the resonator line between the injector and the resonator throttle preferably corresponds substantially to the length of the high-pressure line between the injector and the entry of the high-pressure line into the high-pressure accumulator.

According to a further preferred further development, it is provided that the length of the resonator line between the injector and the resonator throttle as well as the length of the high-pressure line between the injector and the entry of the high-pressure line into the pressure accumulator is each an integer multiple of the wavelength of the pressure vibration induced by the injector.

In the following, the invention will be explained in more detail by way of exemplary embodiments schematically illustrated in the drawing.

FIG. 1 schematically illustrates the structure of a common rail injector including a pressure vibration attenuation means according to a first embodiment;

Figure 5:
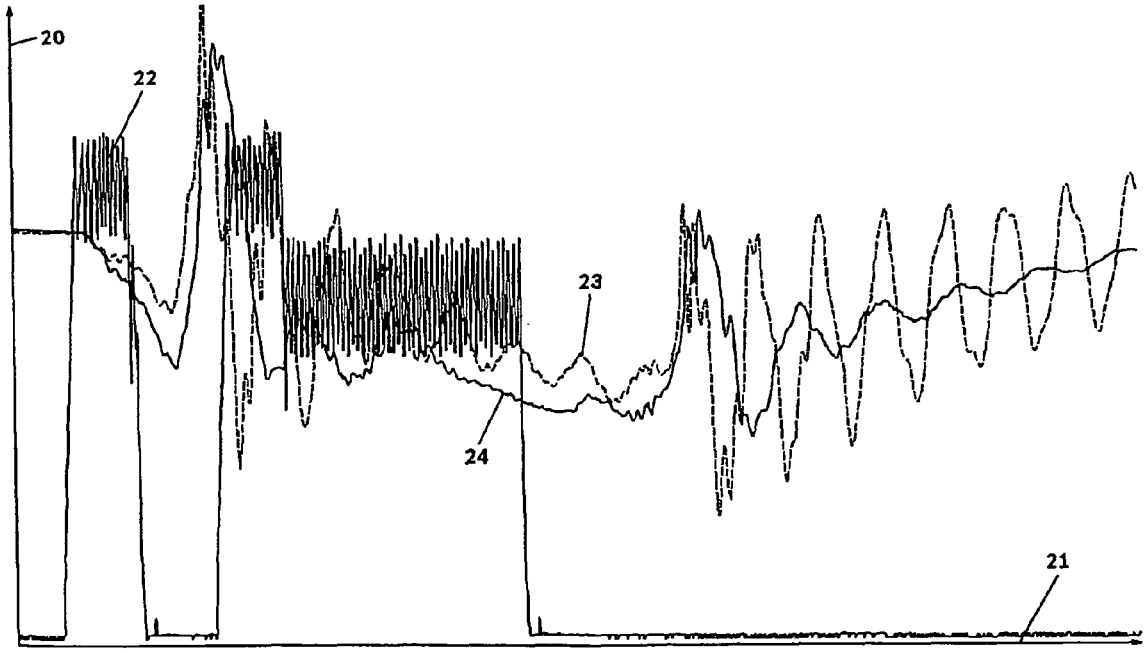

FIG. 5 indicates the pressure course in an injector according to the invention.

Figure 1:
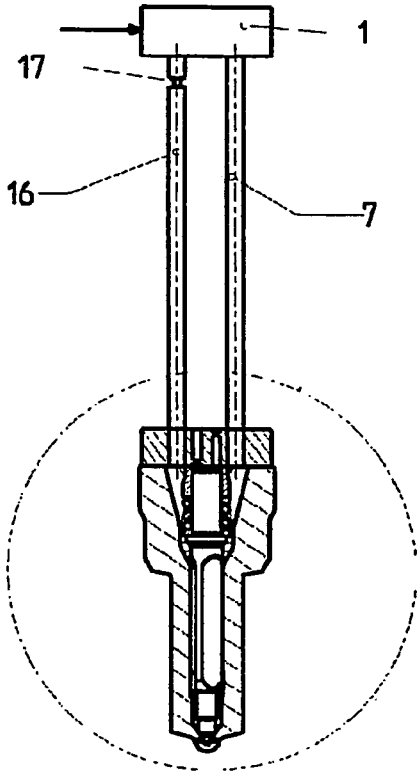
Figure 2:
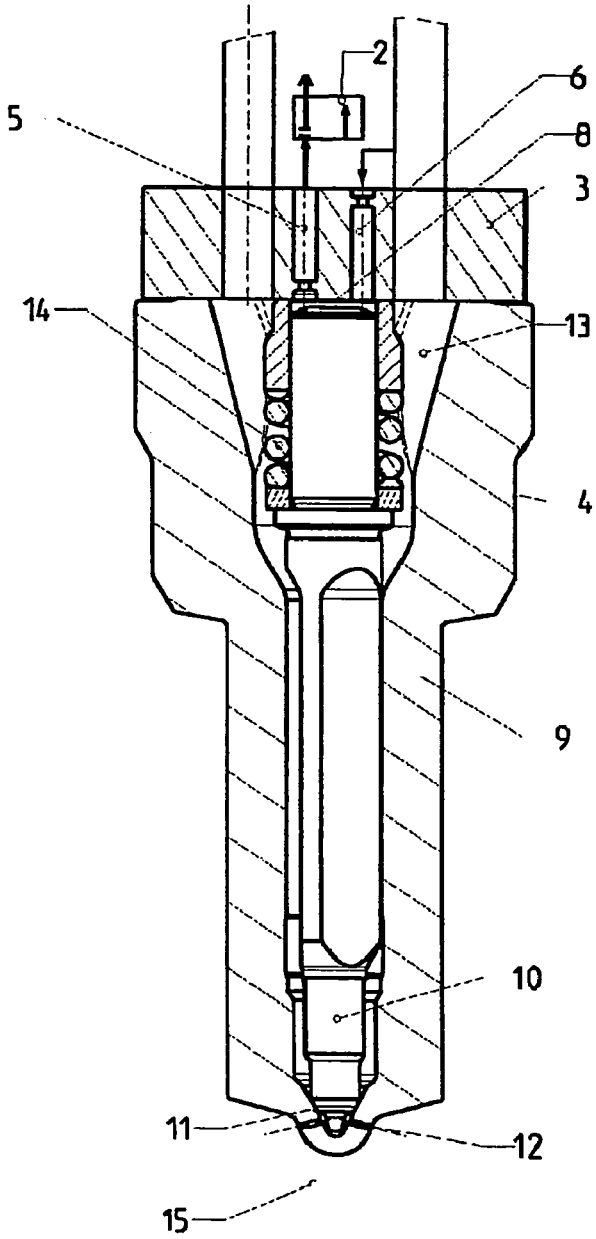
FIG. 2 is an enlarged view of the lower injector portion.

FIGS. 1 and 2 schematically depict the structure of a common rail injector comprising a high-pressure accumulator 1, a servo valve 2, a throttle plate 3 as well as an injection nozzle 4. In the resting state, the servo valve 2 closes the drain throttle 5 provided in the throttle plate 3. This causes the application of the system pressure in the control chamber 8 communicating with the accumulator 1 via a high-pressure bore 7 and a supply throttle 6, such that the nozzle needle 10 is pressed against the nozzle seat 11 formed within the nozzle body 9 and the spraying holes 12 are closed. By actuating the servo valve 2, the drain throttle 5 is released and the fuel present in the control chamber reduces its pressure in the low-pressure system (not illustrated). At the same time, fuel under high pressure flows in through the supply throttle 6. The effective flow cross-sections of the drain throttle 5 and the supply throttle 6 are tuned to each other in a manner that, upon actuation of the servo valve 2, the pressure in the control chamber 8 decreases until the pressure in the nozzle chamber 13 acting on the lower part of the nozzle needle 10 presses the nozzle needle 10 out of the nozzle seat 11 against the pressure in the control chamber 8 and against the force of the nozzle spring 14, thus releasing the spraying holes 12 so as to allow the injection of fuel into the combustion chamber 15. After having closed the servo valve 2, fuel can no longer flow out of the control chamber 8 via the drain throttle 5, so that the pressure building up there will again press the nozzle needle 10 into the nozzle seat 11. Due to the inertia of the fuel in the accumulator 1, high-pressure bore and nozzle chamber 13, strong pressure vibrations will be caused on the nozzle seat 11 immediately after the closure of the nozzle needle, since the flowing fuel must be braked within a very short time. A resonator is used to reduce the pressure vibrations. It is comprised of a resonator bore 16 having the same length and diameter as the high-pressure bore 7, as well as a resonator throttle 17 attached to the accumulator-side end of the resonator bore 16 and connecting the latter with the accumulator 1. Closure of the servo valve causes the pressure pulse forming on the nozzle seat to propagate via the nozzle chamber 13 into the high-pressure bore 7 and the resonator bore 16. At the end of the high-pressure bore 7, a reflection of the pressure pulse takes place on the open end at the transition into the accumulator 1. At the same time, the pressure pulse running in the resonator bore 16 is reflected on the resonator throttle 17 on the closed end. The two reflected pressure pulses are phase-shifted by 180° on account of the different types of reflection (open and closed ends, respectively) so as to be extinguished when meeting with each other in the nozzle chamber 13. No further pressure pulses will thus be generated on the nozzle seat 11, so that a markedly reduced wear will occur there.

Figure 3:
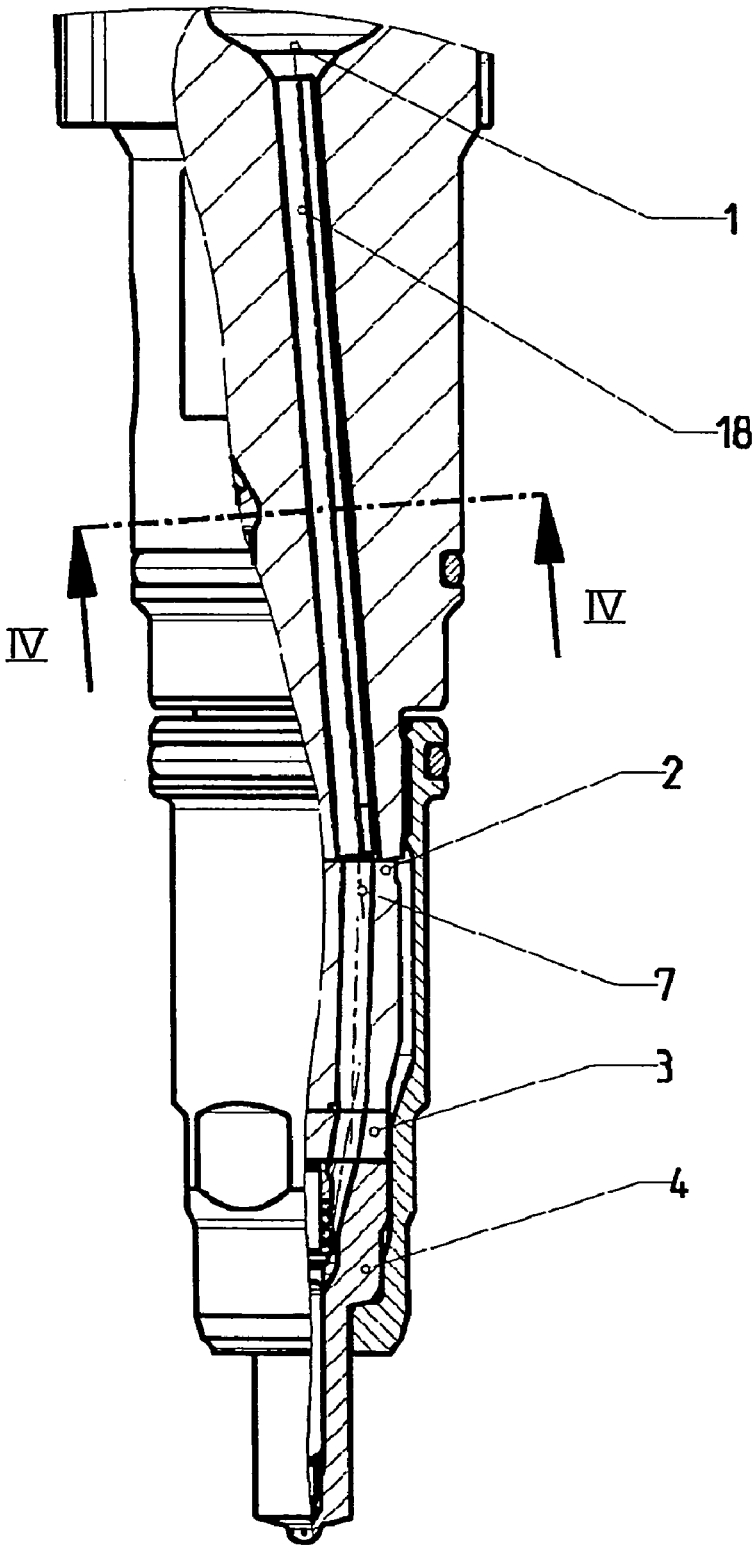
FIG. 3 depicts a modified configuration of the pressure vibration attenuation means.
Figure 4:
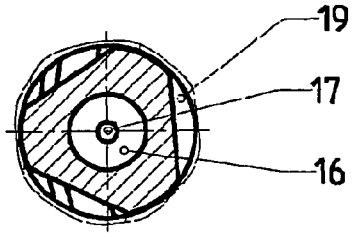
FIG.4 illustrates a section along line IV-IV of FIG. 3.

FIGS. 3 and 4 depict the configuration of an injector according to the invention. An insert piece 18 is pressed into the high-pressure line 7, which leads from the accumulator 1 to the injection nozzle 4 via the valve group 2 and the throttle plate 3. FIG. 4 illustrates the cross section of the insert piece 18. The high-pressure bore itself is designed in the form of several identical circular-segment portions 19. In the axis of the insert piece 18 is provided the resonator bore 16, in which the resonator throttle 17 is arranged on the accumulator-side end. In a preferred manner, the total cross-sectional area of the circular-segment portions 19 is of the same size as the cross-sectional area of the resonator bore 16, and the diameter of the resonator bore 16 is four times as large as the diameter of the resonator throttle 17.

FIG. 5 indicates the course of the pressure 20 as a function of the time 21 in the nozzle chamber 13. Using the current profile 22 for activation will result in the pressure course 23 without a resonator, and in the pressure course 24 with a resonator.

The invention claimed is:

1. A device for the injection of fuel into the combustion chamber of an internal combustion engine, including at least one high-pressure accumulator, an injector, at least one high pressure line connecting the high-pressure accumulator with the injector, and a resonator line arranged in parallel with the high-pressure line between the injector and the high-pressure accumulator and including a resonator throttle on the side of the high-pressure accumulator, characterized in that the resonator line is comprised of an insert piece pressed into the bore of the high-pressure line and is, in particular, formed within the same.

2. A device according to claim 1, wherein the resonator throttle is arranged at the entry of the resonator line into the high-pressure accumulator.

3. A device according to claim 1, wherein the length of the resonator line is tuned to the length of the high-pressure line in such a manner as to cause the mutual attenuation or extinction of the pressure vibrations induced by the injector.

4. A device according to claim 1, wherein the length of the resonator line between the injector and the resonator throttle as well as the length of the high-pressure line between the injector and the entry of the high-pressure line into the pressure accumulator is each an integer multiple of the wavelength of the pressure vibration induced by the injector.

5. A device according to claim 1, wherein the length of the resonator line between the injector and the resonator throttle substantially corresponds with the length of the high-pressure line between the injector and the entry of the high-pressure line into the pressure accumulator.

6. A device according to claim 1, wherein the resonator line is designed as a central bore in the insert piece.

7. A device according to claim 1, wherein the cross sections of the insert piece and the bore of the high-pressure line have mutually differing contours such that flow cross-sections of the high-pressure line are formed between the insert piece and the wall of the bore of the high-pressure line.

8. A device according to claim 1, wherein at least two and, preferably, three circular-segment shaped flow cross-sections are provided.

9. A device according to claim 1, wherein the flow cross-section of the high-pressure line substantially corresponds to the flow cross-section of the resonator line.

10. A device according to claim 1, wherein the free diameter of the resonator throttle amounts to 10 to 50%, preferably about 25%, of the diameter of the resonator line.

11. A device according to claim 1, wherein a pressure accumulator is provided for each injector, which pressure accumulators communicate with a common high-pressure supply line.

12. A device according to claims 1, wherein the injectors are injectors of a common rail system.

13. A device according to claim 1, wherein the pressure accumulator as an accumulator common rail.

* * * * *